US012644289B2

(12) United States Patent
Wenger et al.

(10) Patent No.: US 12,644,289 B2
(45) Date of Patent: Jun. 2, 2026

(54) HORIZONTAL CABLE RAILING AND METHOD OF INSTALLATION

(71) Applicant: Key-Link Fencing & Railing, Inc., New Holland, PA (US)

(72) Inventors: Earl M. Wenger, Leola, PA (US); Elmer Weaver, Denver, PA (US); Daniel Fisher, New Holland, PA (US)

(73) Assignee: Key-Link Fencing & Railing, Inc., New Holland, PA (US)

( * ) Notice: Subject to any disclaimer, the term of this patent is extended or adjusted under 35 U.S.C. 154(b) by 351 days.

(21) Appl. No.: 18/508,424

(22) Filed: Nov. 14, 2023

(65) Prior Publication Data

US 2025/0154772 A1 May 15, 2025

(51) Int. Cl.
*E04F 11/18* (2006.01)

(52) U.S. Cl.
CPC ... *E04F 11/1859* (2013.01); *E04F 2011/1821* (2013.01); *E04F 2011/1827* (2013.01)

(58) Field of Classification Search
CPC ... E04H 17/127; E04H 17/131; E04H 17/133; E04H 17/135; E04H 17/139; E04F 11/18; E04F 11/1808; E04F 11/181; E04F 11/1812; E04F 11/1814; E04F 11/1817; E04F 11/1846; E04F 11/1859; E04F 2011/1819; E04F 2011/1821; E04F 2011/1827; F16G 11/04
See application file for complete search history.

(56) References Cited

U.S. PATENT DOCUMENTS

| | | | | |
|---|---|---|---|---|
| 2,463,144 | A * | 3/1949 | Buchanan | H01R 4/308 439/805 |
| 4,192,215 | A * | 3/1980 | Hymans | E04C 5/122 52/223.13 |
| 6,141,928 | A * | 11/2000 | Platt | E04F 11/1814 52/832 |
| 7,044,448 | B1 * | 5/2006 | Jones | E04F 11/181 256/65.01 |
| 7,198,253 | B2 * | 4/2007 | Striebel | E04F 11/1834 403/275 |
| 8,117,798 | B2 * | 2/2012 | Bergman | E04H 12/2253 403/283 |
| 8,276,334 | B2 * | 10/2012 | Mathews | F16G 11/106 52/223.13 |
| 8,286,309 | B2 * | 10/2012 | Landry | F16G 11/048 403/374.1 |
| 8,936,233 | B1 * | 1/2015 | Sneith | E04F 11/1812 256/67 |
| 9,126,289 | B2 | 9/2015 | Herman | |
| 9,181,967 | B2 * | 11/2015 | Lim | E04C 5/165 |
| 9,249,577 | B2 | 2/2016 | Ross | |
| 9,932,754 | B2 * | 4/2018 | Schlatter | E04H 17/127 |
| 10,221,522 | B1 * | 3/2019 | Henderson | E04F 11/1859 |

(Continued)

FOREIGN PATENT DOCUMENTS

| | | | | |
|---|---|---|---|---|
| FR | 3000531 A1 * | 7/2014 | | F16G 11/12 |
| WO | WO-2019100225 A1 * | 5/2019 | | F16G 11/12 |

*Primary Examiner* — Amber R Anderson
*Assistant Examiner* — Kevin J Baynes
(74) *Attorney, Agent, or Firm* — Saxton & Stump, LLC

(57) ABSTRACT

A method of assembling and installing a horizontal cable infill deck railing system is disclosed in which cables are strung between posts and balusters as required and the cables are tightened by the user of a novel cable attachment system.

3 Claims, 8 Drawing Sheets

(56) References Cited

U.S. PATENT DOCUMENTS

| | | | | |
|---|---|---|---|---|
| 10,352,066 | B2 * | 7/2019 | Schlatter | E04H 17/127 |
| 10,436,231 | B2 * | 10/2019 | White | F16G 11/025 |
| 10,655,358 | B2 * | 5/2020 | Sorkin | E01F 15/06 |
| 10,947,754 | B2 * | 3/2021 | Sorkin | F16G 11/048 |
| 10,975,591 | B2 * | 4/2021 | Kennedy | E04F 11/1859 |
| 11,230,843 | B2 * | 1/2022 | Kennedy | E04F 11/1859 |
| 11,300,180 | B2 * | 4/2022 | Graber | F16G 11/12 |
| 11,629,502 | B1 * | 4/2023 | Smitchko | E04F 11/1859 256/47 |
| 11,643,838 | B2 * | 5/2023 | Burt | E04F 11/1859 256/48 |
| 11,732,482 | B2 * | 8/2023 | Burt | E04F 11/1859 256/59 |
| 11,814,862 | B2 * | 11/2023 | Kennedy | E04H 17/127 |
| 12,000,166 | B2 * | 6/2024 | Burt | E04H 17/163 |
| 12,281,478 | B2 * | 4/2025 | Erickson | E04F 11/1848 |
| 2005/0071958 | A1 * | 4/2005 | Toimil | F16G 11/106 24/136 R |
| 2011/0084180 | A1 * | 4/2011 | Toimil | F16G 11/106 248/74.2 |
| 2012/0131879 | A1 * | 5/2012 | Bergman | E04F 11/1812 52/704 |
| 2012/0256059 | A1 * | 10/2012 | Toimil | F16G 11/106 248/74.2 |
| 2018/0094450 | A1 * | 4/2018 | Sorkin | E04H 17/124 |
| 2020/0378131 | A1 * | 12/2020 | Rucker | E04F 11/1817 |
| 2023/0123977 | A1 * | 4/2023 | Herman | E04F 11/1817 256/37 |
| 2023/0366208 | A1 * | 11/2023 | Erickson | E04F 11/1817 |
| 2024/0026687 | A1 * | 1/2024 | Lord | E04F 11/1859 |
| 2024/0110381 | A1 * | 4/2024 | Schneider | E04F 11/1859 |

* cited by examiner

HORIZONTAL CABLE RAILING AND METHOD OF INSTALLATION

FIELD OF THE INVENTION

The present disclosure is generally directed to railing systems, particularly those cable railing systems used in residential and commercial settings to prevent falls from an elevated surface such as a deck or stairs.

BACKGROUND OF THE INVENTION

Most building codes require that decks and associated stairs have sturdy railings to prevent accidental falls.

Cable railing is often chosen for this application for strength, cost, and aesthetics. Cable railing provides the barrier strength needed to prevent someone at a cookout from falling off a raised platform or deck while reaching for another hot dog, and to prevent someone in line for a roller coaster from falling off the steps leading to the platform. Cable railing can be comparatively inexpensive, at least as compared to completely wooden structures. Additionally, cable railing presents a clean and unobtrusive barrier that many prefer.

Cable railing, however, is not without its disadvantages. Notably, construction and tightening of the cables can be challenging and contribute to the installation cost. Further, some utilitarian installations can have an industrial look that can clash with an artful landscape.

What is needed is a cable railing system that simplifies installation and provides a clean, aesthetic final appearance.

Other features and advantages will be made apparent from the present specification. The teachings disclosed extend to those embodiments that fall within the scope of the claims, regardless of whether they accomplish one or more of the needs mentioned above.

SUMMARY OF THE INVENTION

Herein is disclosed a cable railing system that addresses these needs.

One aspect of the cable railing system is a tightening component comprised of a sleeve or receiver, having female threads, encasing a threaded capsule. The capsule is adapted to grip an inserted cable. The capsule can then be driven into the receiver by turning the receiver with a common hand tool, thereby tightening the cable. The tightening component further has features that help guide an inserted cable toward the gripping means of the capsule. The design of the tightening component masks and conceals the attachment point of the cable from casual inspection, yielding a cleaner final appearance.

Further, the subject matter of this application discloses a method of installing a horizontal cable infill railing using the disclosed tightening component.

Other features and advantages of the present invention will be apparent from the following more detailed description of the preferred embodiment, taken in conjunction with the accompanying drawings, which illustrate, by way of example, the principles of the invention.

BRIEF DESCRIPTION OF DRAWINGS

Wherever possible, the same reference numbers will be used throughout the drawings to represent the same parts.

DETAILED DESCRIPTION OF THE INVENTION

Figure 1:
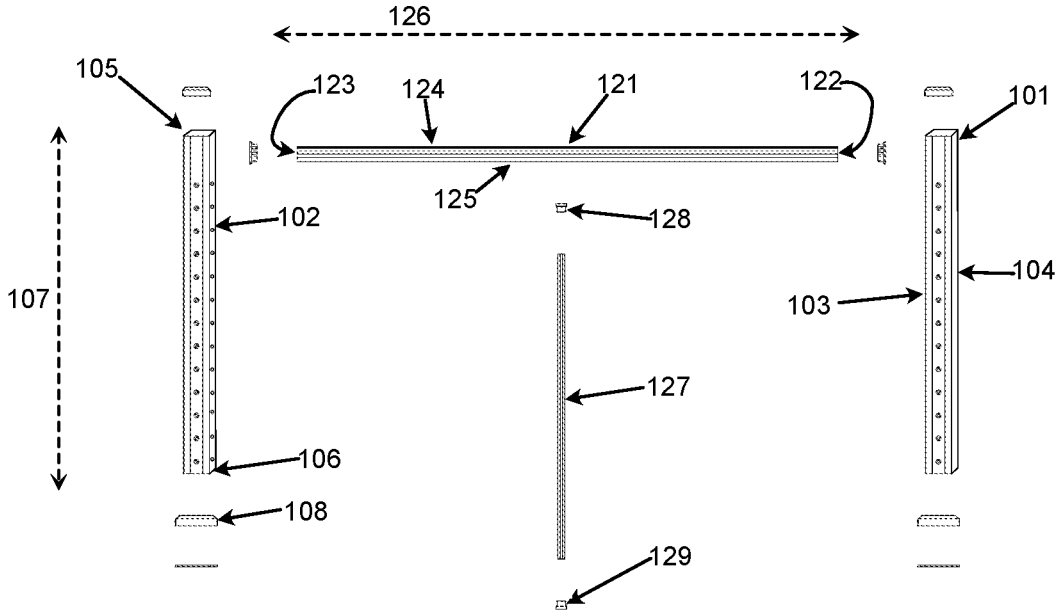
FIG. 1 illustrates an exploded segment of the horizontal railing.
Figure 2:
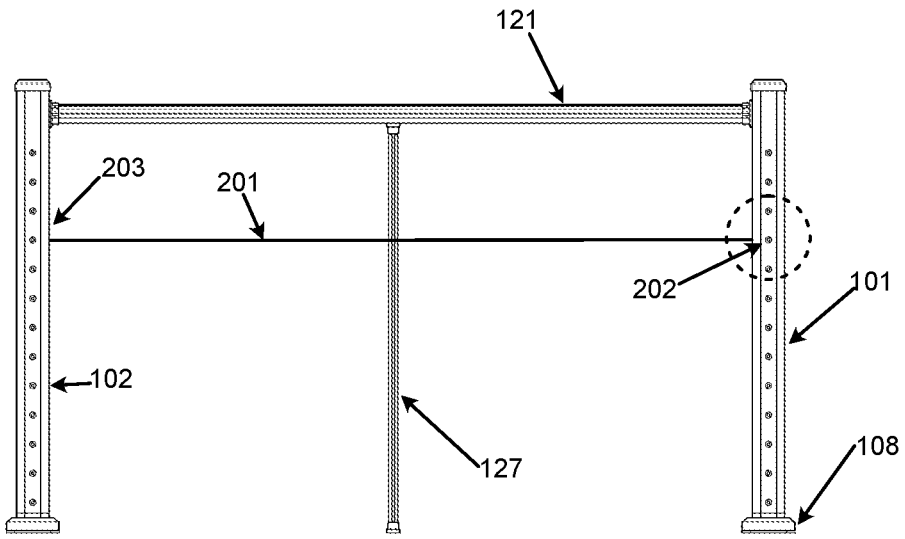
FIG. 2 illustrates a segment of the horizontal railing.
Figure 2A:
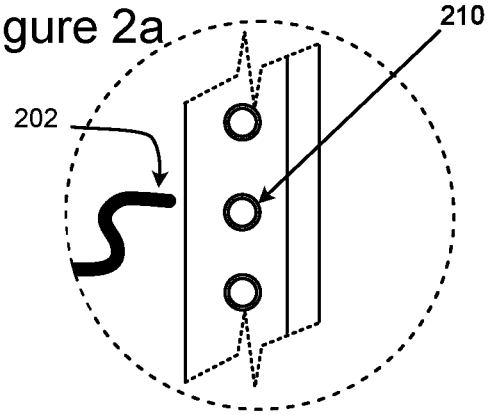
FIG. 2*a* is an enlarged view of the area of the dashed circle in FIG. 2 illustrating cable to be inserted into a cable receiver.
Figure 3:
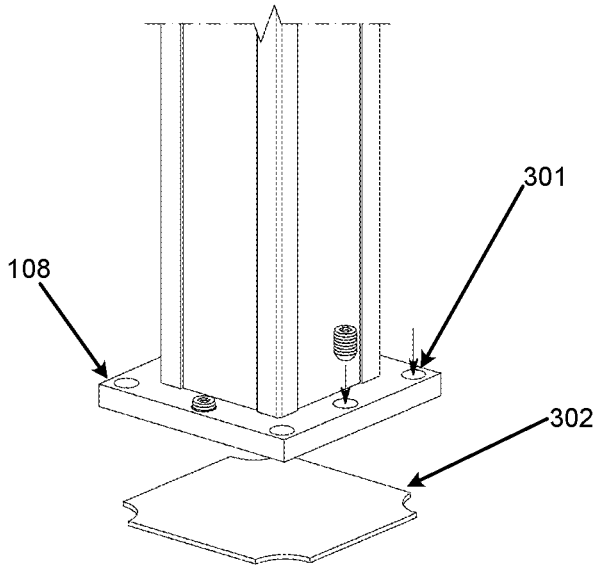
FIG. 3 illustrates a post being attached to a mounting surface.
Figure 4:
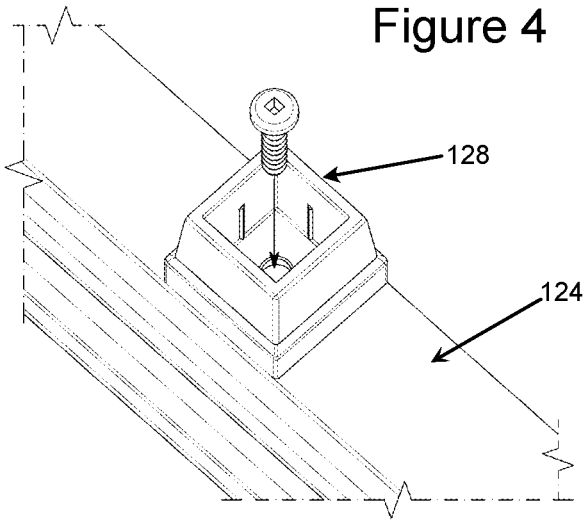
FIG. 4 illustrates a baluster mount being attached to a rail.
Figure 5:
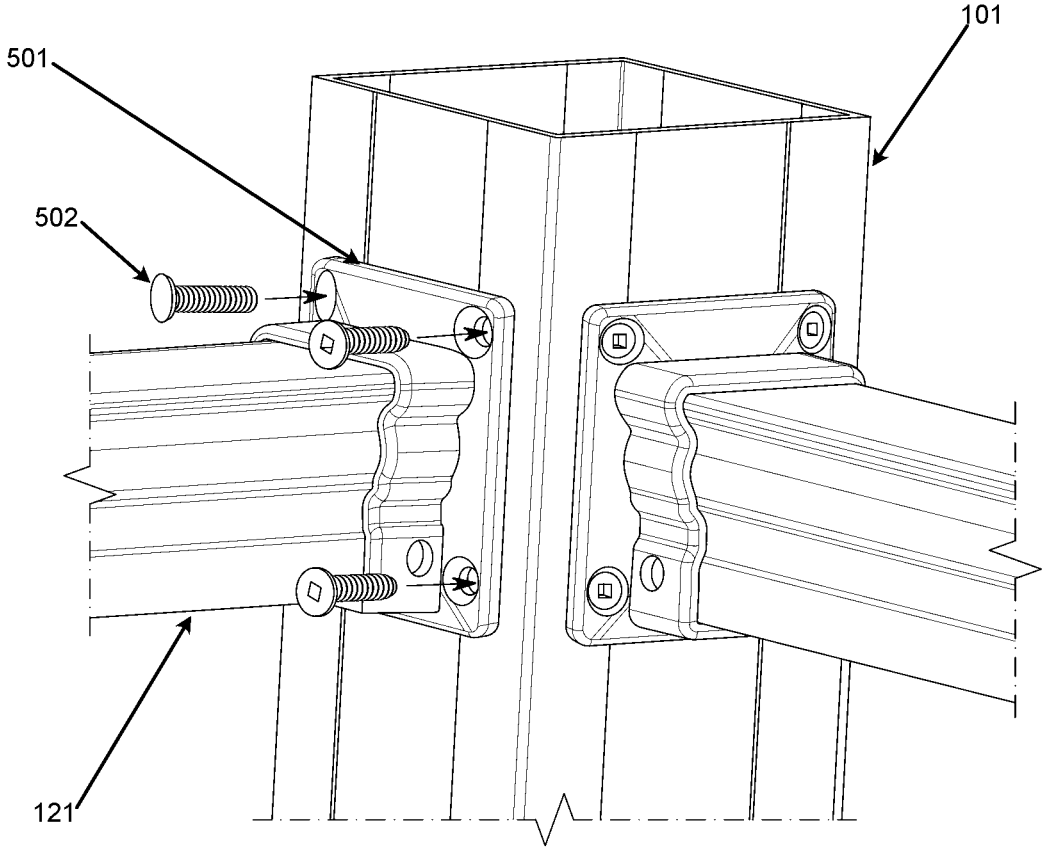
FIG. 5 illustrates the attachment of a rail to a post.
Figure 6:
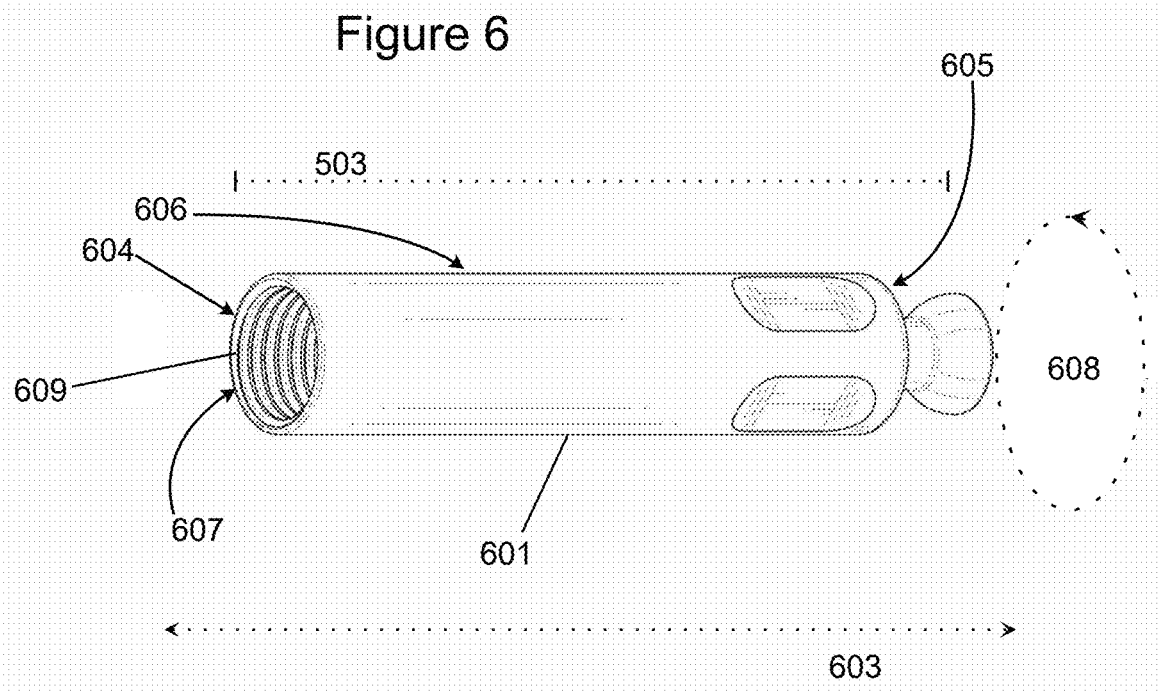
FIG. 6 is an illustration of the sleeve of a cable receiver.
Figure 7:
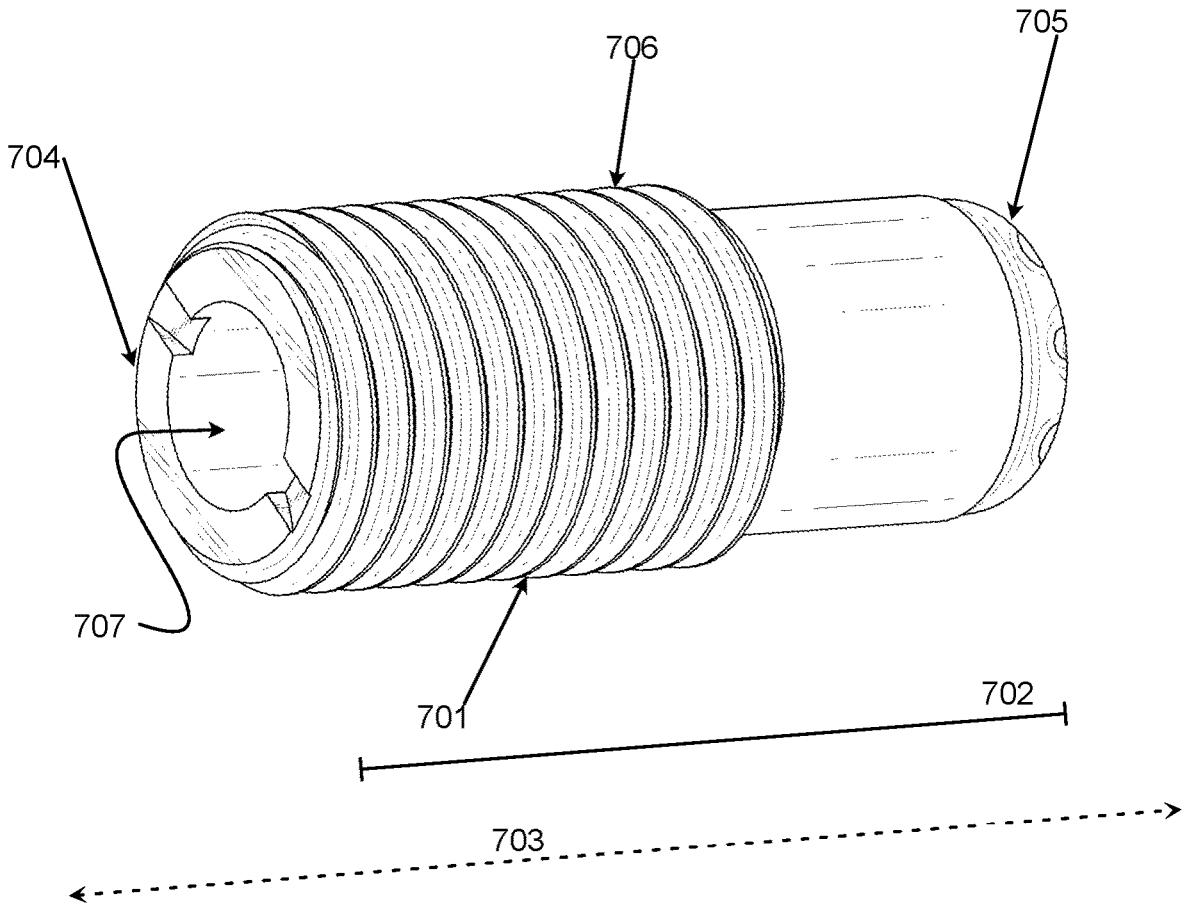
FIG. 7 is an illustration of a capsule of a cable receiver.
Figure 8:
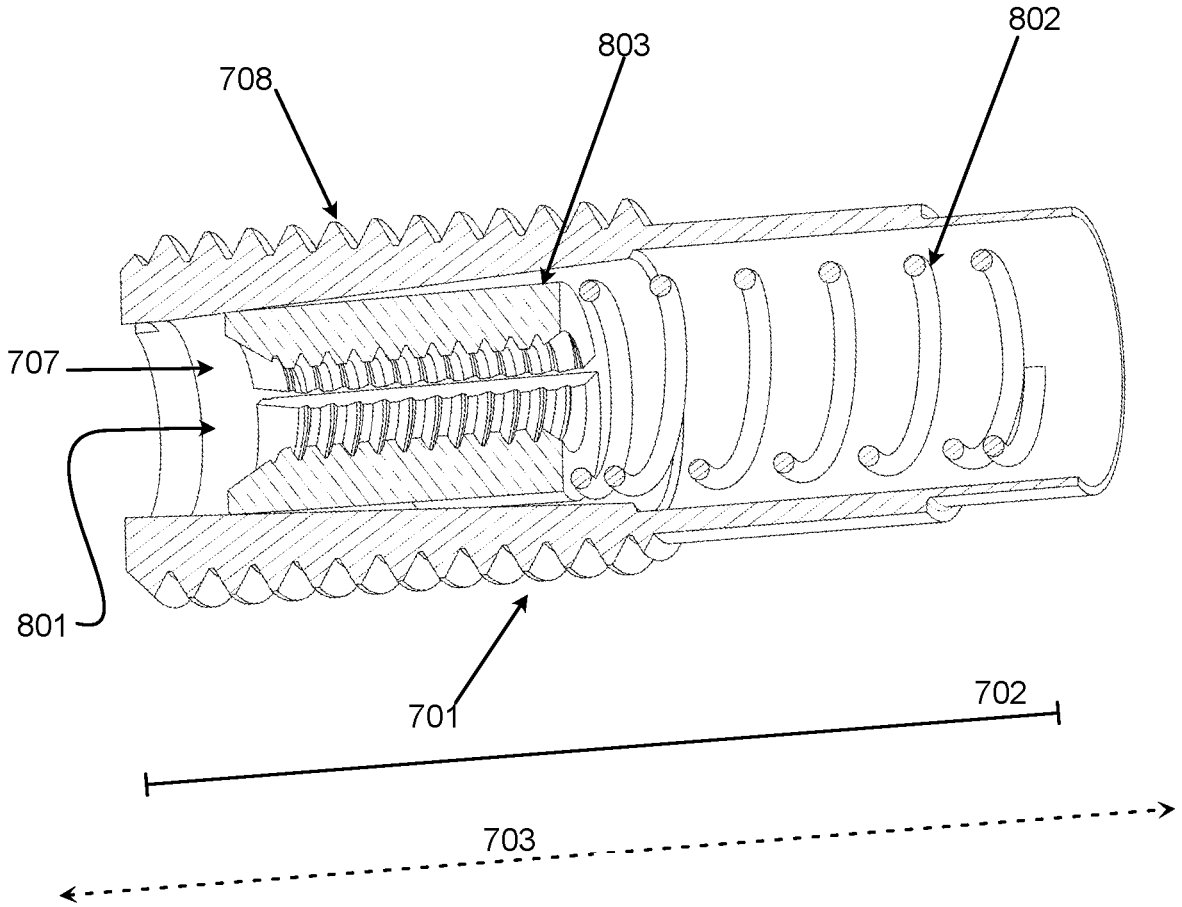
FIG. 8 is a cross-section of a capsule of a cable receiver.
Figure 9:
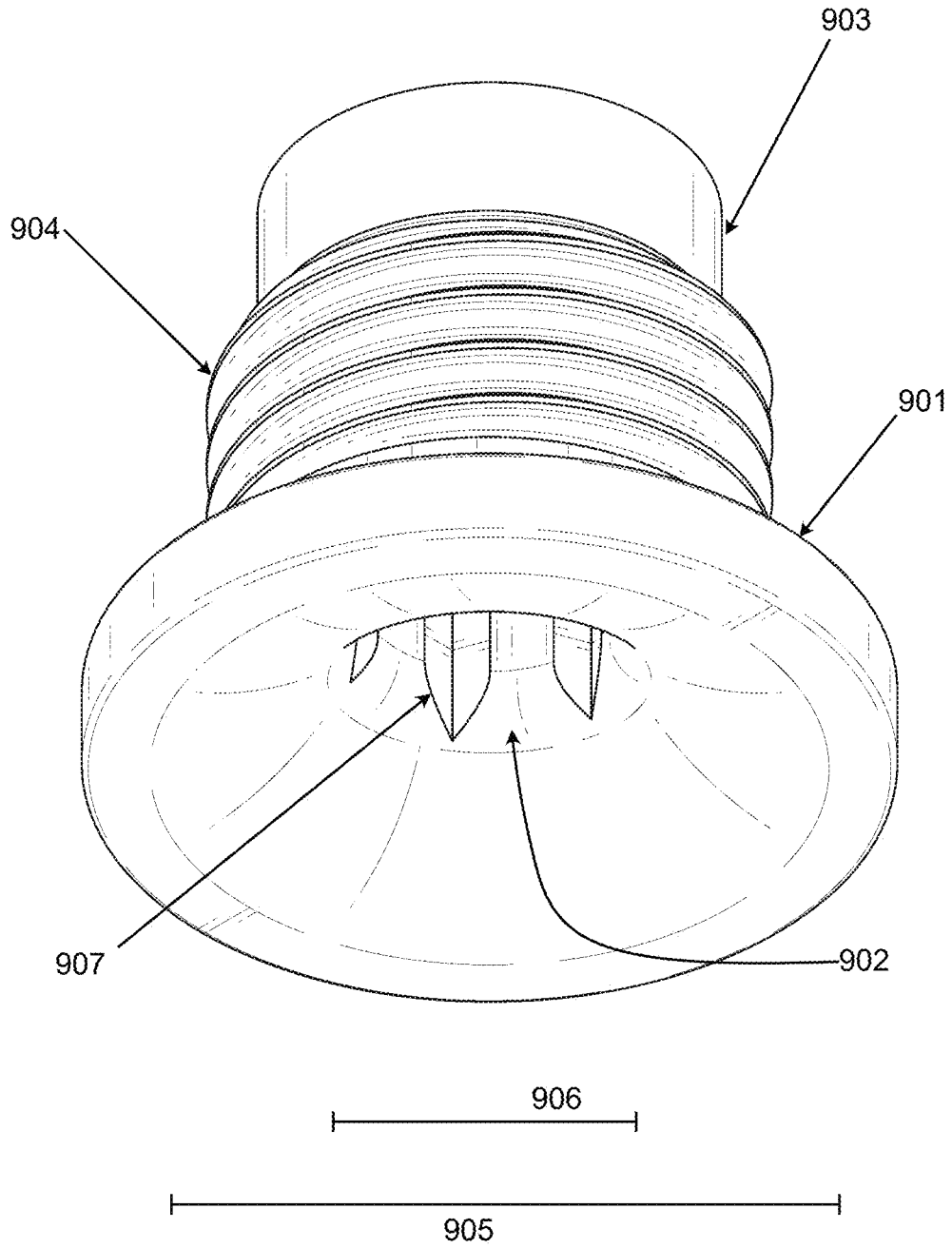
FIG. 9 is an illustration of a flange-head hollow screw.

Each reference number consists of three digits. The first digit corresponds to the figure number in which the referenced item is first or best shown. Reference numbers are not necessarily discussed in the order of their appearance in the figures. Drawings are not necessarily to scale. As used herein, "has" and "have" mean "comprising." Although a "post" is described as a free-standing vertical structure, the term should be understood to include all similar structural members. Similarly, a "baluster" includes any member performing the supporting function of a baluster as described. Relatedly, although a rail is described as a solid piece of material connected to the extremities of two posts, such rails may be otherwise positioned. "Rail" means a top, bottom, or any other rail. For ease in drafting, and hopefully also of reading, aspects of the subject matter of this application are described in terms of a single segment of railing between two posts; however, the teachings of this disclosure apply to, and are most commonly used with multiple railing segments. Also, for ease of drafting and hopefully reading, the procedure for attaching and tightening a cable is described once. However, in practice, most cable railings will be comprised of several cables.

While the embodiments illustrated in the figures and described herein are presently preferred, these embodiments are just examples. Those skilled in the relevant arts may appreciate modifications that could be made but which do not materially depart from the teaching of this disclosure. The subject matter of this application is not limited to a particular embodiment but extends to various modifications that nevertheless fall within the scope of the claims. The order or sequence of any processes or method steps may be varied or re-sequenced according to alternative embodiments. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes, and omissions may be made in the design, operating conditions, and arrangement of the exemplary embodiments without departing from the scope of the present application.

A method of assembling a horizontal cable infill segment for a deck railing comprises the steps of providing a first cable rail support post (101) and a second cable rail support post (102). Each said cable rail support post is comprised of an elongated member having a first side (103), a second side (104), a top (105), a bottom (106), and a longitudinal axis (107). The bottom of each elongated member also has a base support flange (108) comprising a number of mounting holes (301). Further provided is a leveling plate (302). Once so provided, each bottom of a cable rail support post is positioned on a mounting surface such as, e.g., a deck, and a leveling plate is placed between the cable rail support post and the mounting surface. Holes are drilled through the mounting holes of each support flange into the mounting surface, and the cable rail support posts are fixed into place with suitable mounting hardware.

The assembly method also providing a top rail (121) having a first end (122), a second end (123), a top (124), a bottom (125), and a longitudinal axis (126) perpendicular to the longitudinal axis of the mounted cable rail support posts; a baluster (127), a first baluster mount (128) and a second baluster mount (129). Once so provided, the first baluster mount is attached to the bottom of the top rail, approximately the same distance from the first end of the top rail and the second end of the top rail. The top rail is placed to span the first cable rail support post and the second cable rail support post. The second baluster mount is attached to the mounting surface directly below the first baluster mount. The baluster is attached to the first and the second baluster mount, the first end of the top rail is attached via a bracket (501) and screws (502) to the first cable rail support post, and the second end of the top rail is attached to the second cable rail support post. In some embodiments, some embodiments further provide for the attachment of a bottom rail parallel to the top rail and which, in those installations, is the mounting surface to which a baluster mount connects.

Each said cable rail support post further comprises a number of cable receivers comprised of a sleeve (601) and a capsule (701). Each said sleeve has a length, a longitudinal axis (603), a first end (604), a second end (605), an external surface (606), and an internal surface (607). Said internal surface comprises female threads (609) and said second end has an adaptation allowing the sleeve to be turned by a hand tool. In most useful embodiments this adaptation of the second end of the sleeve is a hex socket screw and the hand tool is a hex wrench. Said capsule (701) has a length (702), a longitudinal axis (703), a first end (704), a second end (705), an external surface (706), and an internal surface (707) defining a channel (801). The external surface of the capsule comprises male threads (708) engaged with the female threads on the internal surface of the sleeve.

Within the channel is a gripping adaptation comprising a spring (802) and a plurality of jaw portions (803). Said spring is located near the first end of the capsule and said jaw portions are located near the second end of the capsule. Said jaw portions defining a channel. Said jaws, spring, and the surrounding channel being adapted such that a cable instated through the first end of the capsule presses the ridged jaw portion causing the spring to coil and the channel of the jaw to expand, allowing passage of the cable through the expanded channel. When the tension driving the insertion of the cable is released, the spring uncoils and presses the jaw portions toward the first end of the capsule, causing the jaw portions to tighten around the cable, preventing the release of the cable from the capsule and thereby from the cable receiver.

The most highly preferred embodiments of the cable receiver further comprise a flange-head hollow screw (901) with an internal surface (902), an external surface (903), and male threads (904) suitable for attaching said flange-head hollow screw to the first end of the sleeve. The internal surface of the flange-head hollow screw has a first diameter (905) and a second diameter (906) in which the first diameter is greater than the second. The internal surface of the flange-head hollow screw may also comprise one or more grooves (907) parallel to the longitudinal axis of the capsule.

With the cable rail support posts, rail or rails, and baluster so assembled, a length of cable (201) is run between the cable rail support posts. Said cable has a first end (202) proximal to the first cable rail support post and a second end (203) proximal to the second cable rail support post. One end of the cable is inserted into the proximal cable attachment structure with force sufficient to engage the gripping adaptation of the capsule. The remaining end of the cable is pulled taut and trimmed such that the end of the cable extends approximately 1.25 inches past the entrance point of the proximal cable attachment structure (210); the cable is then inserted into the proximal cable attachment structure with sufficient force to engage the gripping adaptation of the capsule.

Then, to tighten the cable, the cable is held by a pliers or similar tool to prevent rotation while the cable attachment structure is turned (608), thereby driving the capsule into the cable rail support post. This tightening is repeated for each cable attachment.

The invention claimed is:

1. A cable attachment structure comprising a sleeve, a capsule, and a flange-head hollow screw;

said sleeve having a length, a longitudinal axis, a first end, a second end, an external surface and an internal surface;

said internal surface comprising female threads, and said second end adapted to be turned by a tool;

said capsule having a length, a longitudinal axis, a first end, a second end, an external surface and an internal surface;

said external surface of the capsule comprising male threads engaged with the female threads of the internal surface of the sleeve, said second end of the capsule comprising a cable gripping adaptation adapted to grip a cable inserted in the first end of the capsule, and said second end of the capsule further comprising an axial opening having a diameter to allow the insertion of said cable from the first end of the capsule through the opening in the second end of the capsule, said flange-head hollow screw having an internal surface and an external surface, said flange-head hollow screw having a first face in which the internal surface has a diameter, said diameter narrowing to a second diameter within the flange-head hollow screw defining a conical shape, and said external surface of the flange-head hollow screw having male threads adapted to engage the female threads at the first end of the sleeve, and the internal surface of the flange-head hollow screw having grooves parallel to the longitudinal axis of the sleeve.

2. A method of attaching a cable to two static vertical posts and tensioning said cable to a determined level comprising the steps of:

providing a first post having a longitudinal axis, a perpendicular axis, and a cable receiver; and providing a second post having a longitudinal axis, a perpendicular axis, and a cable receiver; and said cable receiver of the first post having a longitudinal axis substantially parallel to the perpendicular axis of the first post; and said cable receiver of the second post having a longitudinal axis substantially parallel to the perpendicular axis of the second post; and each said cable receiver comprising a first end, a second end, an internal surface, a capsule, and a flange-head hollow screw, said first end capped by the flange-head hollow screw, said second end adapted to engage with a turning tool, said internal surface having female threads and defining a chamber, said capsule having an external surface having male threads, an internal surface defining a chamber, a first end, and a second end adapted to grip a cable, said flange-head hollow screw having an internal surface, an external surface, a head, and a terminus; said head having an opening defining a first diameter, said first diameter narrowing to a second diameter within the flange-head hollow screw defining a conical shape.

3. A method of assembling a horizontal cable infill for a deck railing segment, comprising providing a first cable rail support post, the first cable rail support post comprising:

an elongated member having one or more sides, a top, a bottom, and a longitudinal axis;

a base support flange joined with the bottom of the elongated member and comprising a plurality of mounting holes for mounting the first cable rail support post to a mounting surface;

an intervening leveling plate between the base support flange and the mounting surface;

using the mounting holes of the base support flange as a guide to drill holes in the mounting surface;

fixing the first cable rail support post to the mounting surface with mounting hardware;

providing a second cable rail support post, the second cable rail support post comprising:

an elongated member having one or more sides, a top, a bottom, and a longitudinal axis;

a base support flange joined with the bottom of the elongated member and comprising a plurality of mounting holes for mounting the second cable rail support post to the mounting surface;

an intervening leveling plate between the base support flange and the mounting surface;

using the mounting holes of the base support flange as a guide to drill holes in the mounting surface;

fixing the second cable rail support post to the mounting surface with mounting hardware;

the two cable support posts defining a railing axis;

providing a top rail comprising a longitudinal axis, a first end, a second end, a top, and a bottom; and providing a baluster having a top and a bottom; and further providing a first baluster mount and a second baluster mount;

attaching the first baluster mount to the center of the bottom of the top rail;

attaching the second baluster mount aligned with the first baluster mount to a baluster mount attachment surface and equidistant from each of the first and second cable rail support posts and parallel to the railing axis;

attaching the top of the baluster to the first baluster mount, and attaching the bottom of the baluster to the second baluster mount such that the longitudinal axis of the top rail is parallel to the railing axis;

attaching the first end of the top rail to the first cable rail support post, and attaching the second end of the top rail to the second cable rail support post;

each of the first and second cable rail support posts further comprising at least one cable attachment, each said cable attachment comprising a longitudinal axis parallel to the longitudinal axis of the top rail, an entrance point, a threaded internal surface, and a threaded capsule adapted to grip an end of a cable and move in relation to the cable attachment:

running a length of the cable having a first end and a second end from the first cable rail support post to the second cable rail support post;

inserting the first end of the cable into the entrance point of the cable attachment of the first cable rail support post to engage and connect to the threaded capsule;

pulling the second end of the cable taut and trimming said cable so that approximately between 1 and 1.5 inches of cable extends past the entrance point of the cable attachment of the second cable rail support post;

inserting the second end of the cable into the entrance point of the cable attachment of the second cable rail support post to engage and connect to the threaded capsule;

rotating each cable attachment while preventing the cable from rotating to cause each threaded capsule to move deeper within the respective cable attachment pulling the cable taut;

repeating the steps beginning at running a length of cable between the first and second cable rail support posts and commencing at rotating associated cable attachments to tighten the cable as needed;

said entrance point of each cable attachment being capped with a flange-head hollow screw having an internal surface, an external surface, and head, and a terminus;

said head of the flange-head hollow screw having an opening defining a first diameter narrowing to a second diameter within the flange-head hollow screw defining a conical-shaped chamber;

said internal surface of the flange-head screw further comprising one or more grooves that are substantially parallel to the longitudinal axis of the respective cable attachment.

* * * * *